United States Patent [19]

Cottrell et al.

[11] 4,268,742

[45] May 19, 1981

[54] RESISTANCE HEATER ASSEMBLY

[75] Inventors: Merlyn F. Cottrell, Winneconne; Dale J. Gauthier, Omro; Lester C. Miller, Sussex, all of Wis.

[73] Assignee: E. R. Wagner Manufacturing Company, Milwaukee, Wis.

[21] Appl. No.: 85,758

[22] Filed: Oct. 17, 1979

[51] Int. Cl.[3] ..... H05B 3/06

[52] U.S. Cl. ..... 219/532; 174/138 J; 219/374; 219/375; 219/536; 219/542; 338/304; 338/320; 219/347

[58] Field of Search ..... 219/374, 370, 375, 381, 219/354, 532, 536, 538, 535, 537, 542, 345, 347, 349, 350, 351, 352; 174/138 J; 338/299, 304, 315, 317, 320

[56] References Cited

U.S. PATENT DOCUMENTS

| | | | |
|---|---|---|---|
| 1,291,423 | 1/1919 | Crary | 219/532 |
| 1,695,801 | 12/1928 | Dibble | 219/532 |
| 2,179,761 | 11/1939 | Smith | 219/532 X |
| 2,351,466 | 6/1944 | Weida | 219/532 |
| 3,207,887 | 9/1965 | Drugmand et al. | 219/535 |
| 3,530,647 | 9/1970 | Wetzel | 219/381 X |
| 3,691,348 | 9/1972 | Kunz | 219/532 |
| 3,846,619 | 11/1974 | Wightman et al. | 219/532 |
| 4,079,233 | 3/1978 | Meywald | 219/375 |
| 4,151,398 | 4/1979 | Maake | 219/374 |

*Primary Examiner*—Volodymyr Y. Mayewsky
*Attorney, Agent, or Firm*—Bayard H. Michael

[57] ABSTRACT

The coiled resistance heating wire is supported on electrical insulating stand-offs in a figure 8 pattern on each side of a metallic radiation panel. The radiation panel and the figure 8 arrangement of the coil each contribute to increased heat transfer to air flowing axially down the assembly in a duct and in combination result in even more efficient heat transfer.

9 Claims, 7 Drawing Figures

RESISTANCE HEATER ASSEMBLY

Technical Field of the Invention relates to a resistance heater assembly such as used in clothes driers, space heaters and electric heating devices.

BACKGROUND OF THE ART

Electric clothes driers are heated by air forced over an electric resistance wire. In one type the wire is a coiled wire supported by insulators carried by an open rectangular frame and arranged in longitudinal parallel rows on each side of the frame. In effect this provides two parallel planes of heater coils, one on each side of the frame. Air flows across the frame and is heated by contact with the wires and to some extent by adjacent duct surfaces which, of course, are heated by radiation. In was generally thought this arrangement was satisfactory.

CROSS-REFERENCES TO RELATED APPLICATION

The insulated stand-off shown is claimed in co-pending Application Ser. No. 85,757.

SUMMARY OF THE INVENTION

With increasing concern for energy utilization, it is desirable to increase the heating efficiency. This invention is directed to provision of a new heating coil arrangement which increases heat transfer to the air flowing over the heating coil. Two factors contribute to the increased efficiency and each has utility standing alone.

One object of this invention is to increase the heat transferred to the moving air stream by conduction and radiation. This is accomplished by providing a panel between the two planes of heating coils. In the past the coiled resistance wire was supported on both sides of an open frame which contained a minimum of material. It has been found that supporting the coiled wire on both sides of a metal panel results in greater heating of the air than with an open frame support for the same heating coil, the electrical input to the heater being the same in each case. The panel is heated by radiation from the hot-wire and re-radiates and conducts this heat to the air. A further factor is that the metal panel spreads the heat over the panel surface and there is considerable surface for heat transfer to the moving air. The heating increases when the panel surface is treated (oxidized) to be a better acceptor of radiation. When this structure is used in a duct a further increase in efficiency results from in effect having two ducts in the heater area with improved air flow considerations and by reason of higher velocity airflow over the coils.

Another object is to increase the efficiency of heat transfer to the air stream by arranging the coiled resistance wire in a more efficient layout or plan. The wire is arranged generally in a figure 8 on each side of the support structure. Since all turns are on relatively large diameters the spacing between adjacent coil flights on the inside of the turn is greater than possible in prior practice and this greatly reduces hot spots (which decrease life and efficiency). This arrangement increases heat transfer over the prior art parallel rows with the same energy input. The coil diameter is increased over prior practice so there is less radiation in the diametrical sense and the spacing between flights is greater. Both factors reduce spots whereas hot spots were common in the past construction. The larger diameter also gives better hot wire distribution in the moving air stream.

When both the radiation panel and the figure 8 wire arrangement are used together the heat transfer is further increased. The result is a definite improvement in utilization of the electric power supplied to the clothes drier (or to any comparable structure using heated air). Tests indicate the figure 8 arrangement is 2.8% more efficient than the "standard" arrangement. When the figure 8 is used with a radiation panel the efficiency is 3.2% better than the standard.

DETAILED DESCRIPTION OF THE PREFERRED EMBODIMENT

Figure 1:
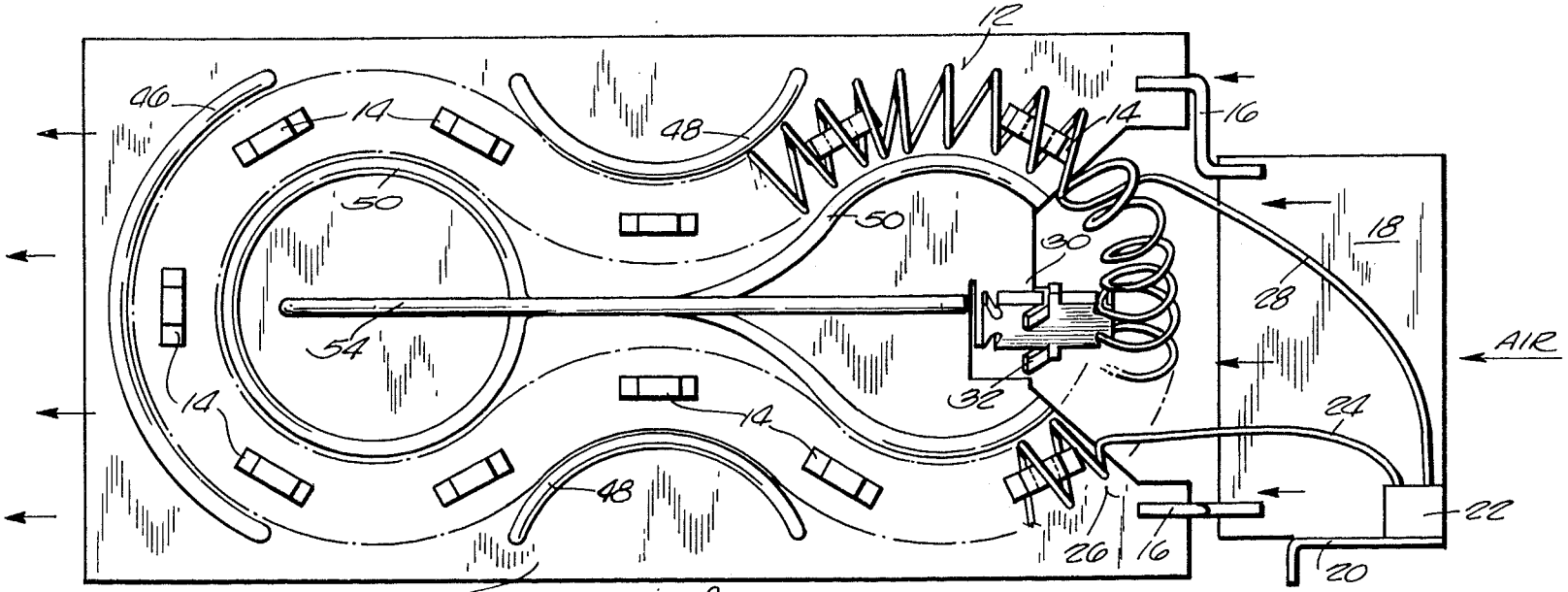
FIG. 1 is a top plan view of a heater assembly incorporating both of the arrangements for increasing heating efficiency.
Figure 2:
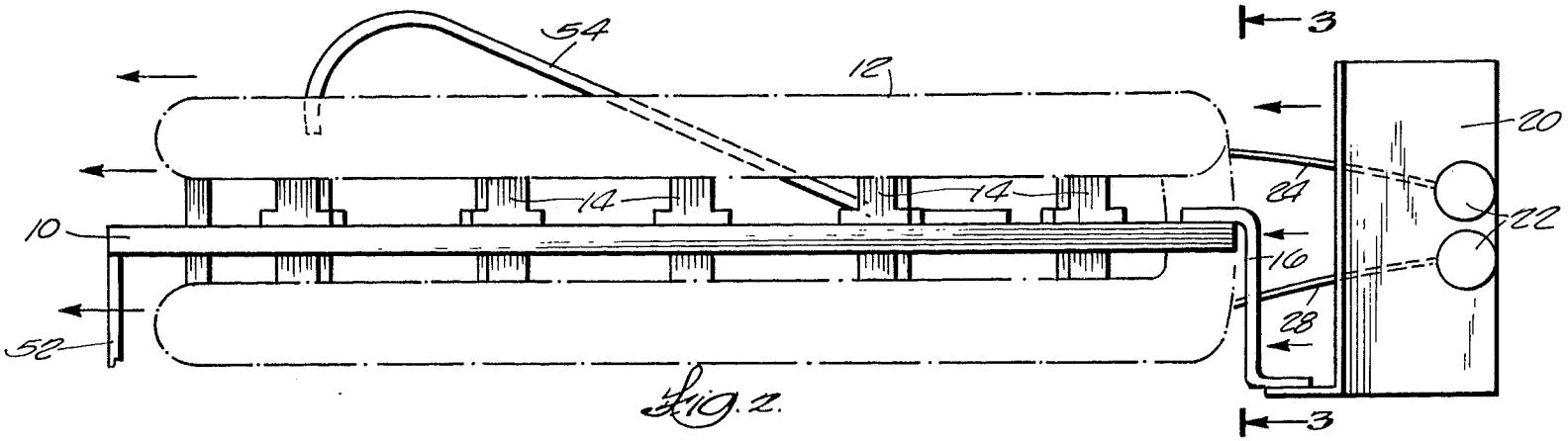
FIG. 2 is a side elevation.
Figure 3:
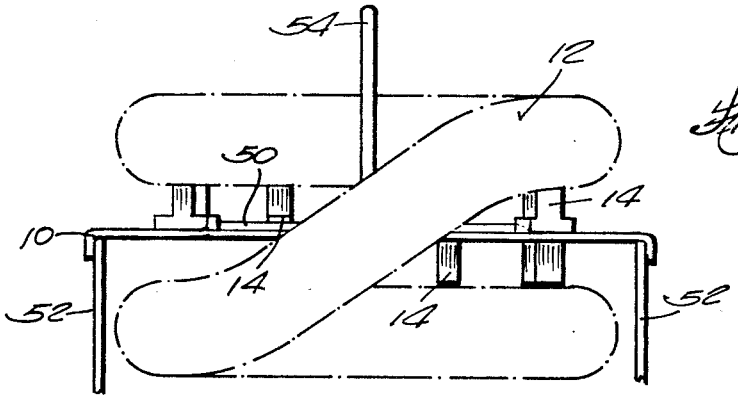
FIG. 3 is a section taken on line 3—3 in FIG. 2.
Figure 4:
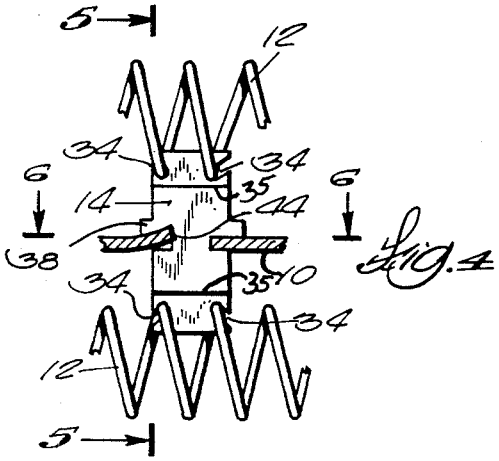
FIG. 4 is a detail of the ceramic stand-off and the assembly of the coiled heater wire to the stand-off on each side of the radiation panel.
Figure 5:
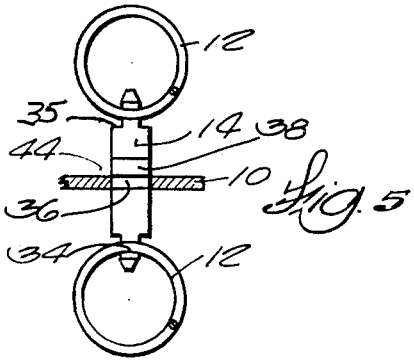
FIG. 5 is a section taken as indicated by line 5—5 on FIG. 4.
Figure 7:
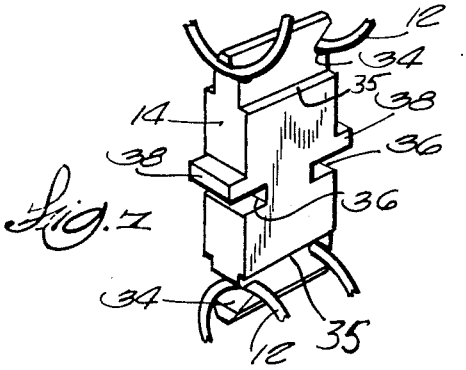
FIG. 7 is a perspective view of the stand-off without the radiation panel.
Figure 6:
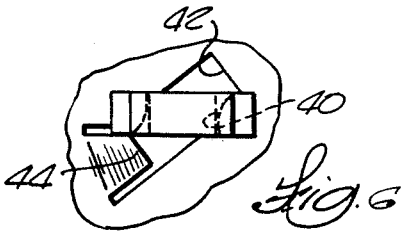
FIG. 6 is a fragmentary sectional view taken as indicated by line 6—6 in FIG. 4.

The heater assembly is designed to be mounted in a duct having a generally rectangular cross section with air flowing from right to left in FIGS. 1 and 2. Air flow can be in any direction across the panel but not normal to the panel. The assembly includes radiation panel 10 which supports the continuous coiled resistance heating wire 12 on stand-offs 14 in a general figure 8 plan on the top and bottom of the panel parallel to the panel. The right or upstream end of the panel has formed wire legs 16 connected to bracket 18 which is designed to be fixed in the duct. The bracket includes an upstanding support 20 for the ceramic wiring terminal block 22. The upper lead 24 leads from the upper terminal to the start of the coiled wire 12 at 26. The other end of the coiled wire 12 is connected to the lower terminally lead 28. The stand-offs 14 are connected to the panel to retain the coiled wire in generally a figure 8 shape or plan parallel to the top surface of panel 10 and at the upstream (right) end of the heater assembly the coiled wire passes downwardly to the underside of the panel as can be seen in FIGS. 1 and 3. The layout of the coiled wire on the bottom of the panel is the same since the stand-offs project through the panel and each stand-off supports the coil above and below the panel. At the transition from the top to the bottom a stand-off is mounted on the tab 30 formed from the panel material with ears 32 gripping the stand-off. Only one end of this stand-off is used to support the coil. As can be seen in FIGS. 4, 5, 6, and 7, the ceramic stand-offs are of a rather simple construction. Each end is provided with opposed upwardly and outwardly diverging slots 34 which grip two loops of the coiled resistance wire 12. In order to get the loops into these slots the wire is turned at 90° from its final position, then lowered over the end of the stand-off until the loops rest on the shoulders 35 to locate the loops adjacent the slots and the wire is then simply turned 90° to cause the loops to enter the slots and be retained by the stand-off. Each stand-off is provided with slots 36 at the midpoint of the stand-off and one end is provided with flanges or ears 38 immediately adjacent the slot 36. In order to mount the stand-off in the panel the end not provided with the ears 38 is passed into a rectangular hole 42 large enough to receive that end. When the shoulders 38 seat against the panel the stand-off is turned to engage an offset rectangular opening 40 intersecting the first so that the panel now enters into the slots 36, 36 and accordingly, grips the stand-off. The stand-off is retained in this position by now turning up tab 44 from the panel to obstruct the adjacent ear 38 and prevent the stand-off from being returned to alignment with the larger rectangular opening. This then locks the stand-off relative to the panel and insures a very accurate location of the stand-off and therefore, of the coiled wire supported by the stand-off. The details of this stand-off configuration and its mounting to the panel considered novel and are subject matter of a copending patent application as noted above.

The panel itself is provided with embossed or raised shapes 46, 48, and 50 to induce turbulence as well as stiffening the panel to resist warping under repeated heating and cooling. The flanges on the perimeter of the panel also stiffen the panel. The lefthand end of the panel is provided with legs 52 and the top surface of the panel has the brace 54 fixed thereto with the lefthand end of the brace unsupported so it may be deflected by the adjacent wall of the duct in which this assembly is designed to be mounted. This securely holds the assembly in the duct and effectively prevents rattling in use.

Tests have demonstrated the present arrangement of the heating coil, i.e. the figure 8, is superior to the standard or traditional parallel rows of coils insofar as utilization of energy is concerned. Thus, as noted above, with the same electrical input the figure 8 achieves a 2.8% improvement in energy utilization, that is, there would be 2.8% less energy used to achieve the same heating of the air. That improvement is obtained with the resistance wire supported on an open frame as in prior designs. When the radiation panel is used in conjunction with the figure 8 configuration the improvement goes up to 3.2%. The panel is preferably oxidized so as to make the panel a better acceptor of radiation and a better radiator. The oxidation achieves a slight roughening effect on the surface and is an improvement over what might be termed a polished or normal smooth finish of a panel as it leaves the normal manufacturing process. It is thought that the panel, being close to the resistance wire, is heated by it and dissipates that heat over the panel surface so as to achieve a greater surface transferring heat to the air passing over the heater assembly. One would assume that with the open frame support heretofore used the radiation to the duct walls (present in this design as well, of course) would be adequate and the remainder of the energy would go to heating the passing air without having to go into a radiation panel. Just why the present design improves upon that is not fully understood but one fact is clear that with the panel between the upper and lower planes of the heater coil the coil planes are not in effect radiating to each other and hot spots heretofore common in heaters of this type seem to be no problem and the life of the resistance wire is accordingly extended and the reliability of the product is increased.

We claim:

1. A heater assembly for installation in a duct comprising, a metallic radiation panel, electrical insulating support members projecting from both sides of the panel, an electric resistance heating wire passing from one side of the panel to the other side of panel and supported on said members on both sides of the panel whereby air flowing along both sides of the panel is heated by the wire and by the panel which is radiantly heated by the wire, said panel being dimensioned so the wire on each side of the panel lies within the perimeter of the panel and radiantly heats the panel and cannot radiantly heat the wire on the other side of the panel.

2. An assembly according to claim 1 in which the panel surface is treated to enhance acceptance of radiation and to increase radiation therefrom.

3. An assembly according to claim 1 in which the wire is coiled and supported generally in a curvilinear figure 8 pattern on each side of the panel.

4. An assembly according to claim 3 in which the wire does not touch at the neck of the 8 and crosses from one side of the panel to the other on the end of the panel which faces upstream in the air flow.

5. A heater wire assembly for installation in a duct, comprising, an elongated radiation support, electrical insulators mounted on both sides of the support and projecting therefrom, an electric resistance heating wire passing from one side of the panel to the other side of the panel and secured to said insulators generally in a curvilinear figure 8 plan on each side of the support with the long axis of the 8 generally parallel to the long axis of the support and parallel to the designed air flow direction.

6. An assembly according to claim 5 in which the wire never touches another portion of the wire and the wire is coiled.

7. An assembly according to claim 6 in which the support is a panel which is radiantly heated by the wire and heats air passing thereover.

8. An assembly according to claim 7 in which the panel is treated to enhance acceptance of radiation.

9. An assembly according to claim 8 in which the wire crosses from one side to the other side of the support panel at the upstream end of the support panel.

* * * * *

UNITED STATES PATENT AND TRADEMARK OFFICE

CERTIFICATE OF CORRECTION

PATENT NO. : 4,268,742

DATED : May 19, 1981

INVENTOR(S) : Dale J. Gauthier et al

It is certified that error appears in the above—identified patent and that said Letters Patent is hereby corrected as shown below:

Column 4, line 40, the word "panel" both occurrence should read --support--.

Signed and Sealed this

*Twenty-fifth* Day of *August 1981*

[SEAL]

*Attest:*

GERALD J. MOSSINGHOFF

*Attesting Officer*

*Commissioner of Patents and Trademarks*